US008588440B2

(12) United States Patent
Koppens et al.

(10) Patent No.: US 8,588,440 B2
(45) Date of Patent: Nov. 19, 2013

(54) SWEET SPOT MANIPULATION FOR A MULTI-CHANNEL SIGNAL

(75) Inventors: Jeroen Gerardus Henricus Koppens, Eindhoven (NL); Erik Gosuinus Petrus Schuijers, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1160 days.

(21) Appl. No.: 12/440,599

(22) PCT Filed: Sep. 10, 2007

(86) PCT No.: PCT/IB2007/053631

§ 371 (c)(1),
(2), (4) Date: Mar. 10, 2009

(87) PCT Pub. No.: WO2008/032255

PCT Pub. Date: Mar. 20, 2008

(65) Prior Publication Data

US 2009/0252338 A1 Oct. 8, 2009

(30) Foreign Application Priority Data

Sep. 14, 2006 (EP) ..... 06120662

(51) Int. Cl.
*H04R 5/02* (2006.01)
*H04R 5/00* (2006.01)

(52) U.S. Cl.
USPC ..... 381/310; 381/1; 381/306

(58) Field of Classification Search
USPC ..... 381/1, 306, 310
See application file for complete search history.

(56) References Cited

U.S. PATENT DOCUMENTS

| | | | | |
|---|---|---|---|---|
| 6,307,941 | B1 | 10/2001 | Tanner, Jr. et al. | |
| 7,783,494 | B2 * | 8/2010 | Pang et al. | 704/500 |
| 2005/0157883 | A1 | 7/2005 | Herre et al. | |
| 2007/0061026 | A1 * | 3/2007 | Wang | 700/94 |

FOREIGN PATENT DOCUMENTS

| | | | |
|---|---|---|---|
| EP | 1565036 | A2 | 8/2005 |
| EP | 1761110 | A1 | 3/2007 |
| WO | 2006033074 | A1 | 3/2006 |

* cited by examiner

*Primary Examiner* — S. V. Clark
*Assistant Examiner* — Jesse Y Miyoshi

(57) ABSTRACT

An apparatus, such as a decoder is arranged to modify the sweet-spot of a spatial M-channel audio signal by modifying spatial parameters. Specifically, a receiver (201) receives an N-channel audio signal where N<M. The M-channel signal may specifically be an MPEG Surround sound signal and the N-channel signal may be a stereo signal. A parameter unit (203) determines spatial parameters relating the N-channel audio signal to the spatial M-channel audio signal and a modifying unit (207) modifies the sweet-spot of the spatial M-channel audio signal by modifying at least one of the spatial parameters. A generating unit (205) then generates the spatial M-channel audio signal by up-mixing the N-channel audio signal using the at least one modified spatial parameter. An efficient and/or low complexity sweet-spot manipulation is achieved by an integration of sweet-spot manipulation and multi-channel generation.

28 Claims, 5 Drawing Sheets

SWEET SPOT MANIPULATION FOR A MULTI-CHANNEL SIGNAL

FIELD OF THE INVENTION

The invention relates to sweet-spot manipulation for a multi-channel signal and in particular, but not exclusively, to sweet-spot manipulation for an MPEG Surround sound multi-channel signal.

BACKGROUND OF THE INVENTION

Digital encoding of various source signals has become increasingly important over the last decades as digital signal representation and communication increasingly has replaced analogue representation and communication. For example, distribution of media content, such as video and music, is increasingly based on digital content encoding.

Furthermore, in the last decade there has been a trend towards multi-channel audio and specifically towards spatial audio extending beyond conventional stereo signals. For example, traditional stereo recordings only comprise two channels whereas modern advanced audio systems typically use five or six channels, as in the popular 5.1 surround sound systems. This provides for a more involved listening experience where the user may be surrounded by sound sources.

Various techniques and standards have been developed for communication of such multi-channel signals. For example, six discrete channels representing a 5.1 surround system may be transmitted in accordance with standards such as the Advanced Audio Coding (AAC) or Dolby Digital standards.

However, in order to provide backwards compatibility, it is known to down-mix the higher number of channels to a lower number and specifically it is frequently used to down-mix a 5.1 surround sound signal to a stereo signal allowing a stereo signal to be reproduced by legacy (stereo) decoders and a 5.1 signal by surround sound decoders.

One example is the MPEG2 backwards compatible coding method. A multi-channel signal is down-mixed into a stereo signal. Additional signals are encoded in the ancillary data portion allowing an MPEG2 multi-channel decoder to generate a representation of the multi-channel signal. An MPEG1 decoder will disregard the ancillary data and thus only decode the stereo down-mix. The main disadvantage of the coding method applied in MPEG2 is that the additional data rate required for the additional signals is in the same order of magnitude as the data rate required for coding the stereo signal. The additional bit rate for extending stereo to multi-channel audio is therefore significant.

Other existing methods for backwards-compatible multi-channel transmission without additional multi-channel information can typically be characterized as matrixed-surround methods. Examples of matrix surround sound encoding include methods such as Dolby Prologic II and Logic-7. The common principle of these methods is that they matrix-multiply the multiple channels of the input signal by a suitable non-quadratic matrix thereby generating an output signal with a lower number of channels. Specifically, a matrix encoder typically applies phase shifts to the surround channels prior to mixing them with the front and center channels.

Another reason for a channel conversion is coding efficiency. It has been found that e.g. surround sound audio signals can be encoded as stereo channel audio signals combined with a parameter bit stream describing the spatial properties of the audio signal. The decoder can reproduce the stereo audio signals with a very satisfactory degree of accuracy. In this way, substantial bit rate savings may be obtained.

Thus, in (parametric) spatial audio (en)coders, parameters are extracted from the original audio signal so as to produce an audio signal having a reduced number of channels, for example only a single channel, plus a set of parameters describing the spatial properties of the original audio signal. In (parametric) spatial audio decoders, the spatial properties described by the transmitted spatial parameters are used to recreate the original spatial multi-channel signal. There are several parameters which may be used to describe the spatial properties of audio signals. One such parameter is the inter-channel cross-correlation, such as the cross-correlation between the left channel and the right channel for stereo signals. Another parameter is the power ratio of the channels.

A specific example of such a technique is the MPEG Surround approach for efficiently coding multi-channel audio signals.

An MPEG Surround encoder down-mixes an M channel input signal to an N channel down-mix signal where N<M, and extracts the spatial parameters. The down-mix signal is typically encoded using a legacy encoder, such as e.g. an MP3 or AAC encoder. The spatial parameters are encoded and embedded into the bit-stream in a backward compatible way such that legacy decoders can still decode the underlying down-mix signal.

In the MPEG Surround decoder, the down-mix signal is first decoded using a legacy decoder. The multi-channel signal is then reconstructed by means of the spatial parameters that are extracted from the bit-stream.

Apart from the typical multi-channel coding as described above, MPEG Surround offers a rich set of additional features, e.g.:

Non-guided decoding—the MPEG Surround decoder is able to create a multi-channel up-mix of stereo signals when the spatial side information described above is not available. In this mode, the decoder calculates the power ratio and correlation of the stereo signal and these characteristics are used to obtain the required spatial parameters by table lookup.

Matrix Compatibility—the MPEG Surround encoder is able to generate a down-mix that can be decoded using existing matrix decoding schemes. The matrix surround down-mix is created such that it can be inverted by an MPEG Surround decoder without perceptual concessions to the decoder performance. Furthermore, matrix surround down-mixes improve the performance of the non-guided mode.

Binaural decoding—the MPEG Surround decoder is able to transform a mono or stereo down-mix signal directly into a 3D binaural stereo signal using the spatial parameters instead of calculating a multi-channel signal as an intermediate step.

Artistic down-mix—MPEG Surround allows transmission of a manually created down-mix instead of the automated MPEG Surround down-mix.

Arbitrary trees—the MPEG Surround bitstream supports definition of arbitrary up-mix structures allowing an arbitrary number of output channels.

The MPEG Surround coder aims at representing the original multi-channel signal as accurately as possible for a predefined speaker setup, such as e.g. a 5.1 setup. However, it does not allow any flexibility with regard to different listening positions and environments such as typically present at home or in a vehicle.

Reproduction for alternative listening positions and environments can be improved by manipulation of the sweet-spot (e.g. moving and/or widening). However, although sweet-spot manipulation is known, conventional approaches tend to be suboptimal and are generally applied as a post-processing step requiring high complexity processing of the individual output channels.

Hence, an improved system for manipulating a sweet-spot would be advantageous and in particular a system allowing increased flexibility, improved quality, improved listening experiences, reduced complexity, facilitated processing and/or improved performance would be advantageous.

SUMMARY OF THE INVENTION

Accordingly, the Invention seeks to preferably mitigate, alleviate or eliminate one or more of the above mentioned disadvantages singly or in any combination.

According to a first aspect of the invention there is provided an apparatus for modifying a sweet-spot of a spatial M-channel audio signal, the apparatus comprising: a receiver for receiving an N-channel audio signal, N<M; parameter means for determining spatial parameters relating the N-channel audio signal to the spatial M-channel audio signal; modifying means for modifying the sweet-spot of the spatial M-channel audio signal by modifying at least one of the spatial parameters; generating means for generating the spatial M-channel audio signal by up-mixing the N-channel audio signal using the at least one modified spatial parameter.

The invention may provide an improved listening experience. The invention may allow a reduced complexity sweet-spot manipulation by directly modifying spatial parameters as part of a decoding process. A facilitated and reduced computational demand processing can be achieved. The apparatus may specifically be a decoder. The invention may allow improved performance by integrating decoding and sweet-spot manipulation in an advantageous way.

The N-channel signal may specifically be a mono or stereo signal and the M-channel signal may specifically be a 5.1, 6.1 or 7.1 surround sound signal. The spatial parameters may specifically be time and frequency variant parameters relating characteristics of the different channels of the spatial M-channel audio signal to the signals of the N-channel signal (or vice versa). For example, the spatial parameters may include level and/or correlation parameters for individual time frequency blocks. The up-mixing of the N-channel audio signal to the spatial M-channel audio signal may be a cascaded up-mixing.

According to an optional feature of the invention, the modifying means is arranged to modify a front to back balance by modifying a first spatial parameter indicative of an intensity difference between at least one front channel and at least one rear channel of the spatial M-channel audio signal.

This may provide an improved listening experience and/or a facilitated sweet-spot manipulation. In particular, this feature may allow an improved listening experience for (front/back) non-central listening positions by a simple and low complexity processing.

According to an optional feature of the invention, the first spatial parameter is an interchannel intensity difference between the at least one front channel and the at least one rear channel.

This may allow a particularly low complexity and/or efficient implementation. In particular, the sweet-spot can be modified using a simple modification of a spatial parameter already used in the decoding operation.

According to an optional feature of the invention, the modifying means is arranged to modify a quantization index of the interchannel intensity difference.

This may allow a particularly low complexity and/or efficient implementation and may in particular allow a facilitated and more user friendly manipulation while reflecting the human audio perception. The quantization index may be modified prior to decoding.

According to an optional feature of the invention, the modifying means is further arranged to scale at least one front channel such that a front side channel to center channel energy ratio variation for the spatial M-channel audio signal caused by modifying the first parameter is reduced.

This may allow an improved listening experience and may in many cases allow a manipulated sweet-spot with minimal perceptual distortion. The modifying means may specifically substantially maintain the same front side channel to center channel energy ratio after the parameter modification as before the modification. The modifying means may specifically scale a center channel or may e.g. scale the side channels substantially equally relative to a center channel and/or may scale the side channels differently.

According to an optional feature of the invention, the modifying means is arranged to modify a center dispersion by modifying a first spatial parameter indicative of a relative distribution of a signal of at least one channel of the N-channel audio signal between a center channel and at least one side channel.

This may provide an improved listening experience and/or a facilitated sweet-spot manipulation. In particular, this feature may allow an increased spatial listening experience.

In some embodiments, the modifying means is arranged to modify a center dispersion by modifying a first spatial parameter indicative of a scaling value between at least one channel of the N-channel audio signal and at least one front channel of the spatial M-channel audio signal.

The up-mixing of the N-channel audio signal may specifically include an up-mixing of the N-channel audio signal to a K channel signal (N<K<=M) by a (K,N) up-mixing matrix multiplication of the signal values for the N-channels signals and the first spatial parameter may be a matrix coefficient of the up-mixing matrix.

According to an optional feature of the invention, the first spatial parameter is a channel prediction coefficient.

This may allow a particularly low complexity and/or efficient implementation. In particular, the sweet-spot can be modified using a simple modification of a spatial parameter typically already used in the decoding operation.

According to an optional feature of the invention, the modifying means is arranged to modify a left to right balance by modifying a first spatial parameter indicative of a relative distribution of a signal of least one channel of the N-channel audio signal between at least one right side channel and at least one left side channel.

This may provide an improved listening experience and/or a facilitated sweet-spot manipulation. In particular, this feature may allow an improved listening experience for (left/right) non-central listening positions by a simple and low complexity processing.

According to an optional feature of the invention, the first spatial parameter is a channel prediction coefficient.

This may allow a particularly low complexity and/or efficient implementation. In particular, the sweet-spot can be modified using a simple modification of a spatial parameter already used in the decoding operation.

According to an optional feature of the invention, the modifying means is arranged to modify a front to back dispersion by modifying a first spatial parameter indicative of a relative correlation between at least one front channel and at least one rear channel of the spatial M-channel audio signal.

This may provide an improved listening experience and/or a facilitated sweet-spot manipulation. In particular, this feature may allow an increased spatial listening experience.

According to an optional feature of the invention, the first spatial parameter is an interchannel correlation coefficient between the at least one front channel and the at least one rear channel.

This may allow a particularly low complexity implementation. In particular, the sweet-spot can be modified using a simple modification of a spatial parameter already used in the decoding operation.

According to an optional feature of the invention, the N-channel audio signal corresponds to a down-mix of the spatial M-channel audio signal and the receiver is arranged to receive encoder spatial parameters relating the down-mixed N-channel audio signal to the spatial M-channel audio signal and the parameter means is arranged to determine the spatial parameters from the encoder spatial parameters.

This may provide an improved listening experience and/or a facilitated sweet-spot manipulation. In particular, this feature may allow an improved listening experience in a system comprising a parametric encoder generating the N-channel audio signal.

The encoder may generate spatial parameter data when down-mixing the spatial M-channel audio signal to the N-channel audio signal. This spatial parameter data may be transmitted to the apparatus and the sweet-spot may be modified by modifying this data. The spatial parameters may specifically comprise the encoder spatial parameters. The N-channel audio signal may specifically be an MPEG Surround signal comprising parametric data.

According to an optional feature of the invention, the parameter means is arranged to determine the spatial parameters from characteristics of signals of the channels of the N-channel audio signal.

This may provide an improved listening experience and/or a facilitated sweet-spot manipulation. In particular, this feature may allow an improved listening experience in a system not using explicit parametric coders which do not transmit parameter data for the spatial M-channel audio signal. The N-channel audio signal may specifically be a non-guided MPEG Surround signal, such as a matrix compatible down-mix signal. The N-channel audio signal may also be a legacy stereo signal, e.g. a stereo MP3 decoded signal, or a stereo FM signal.

According to another aspect of the invention, there is provided a receiver for receiving a spatial M-channel audio signal, the receiver comprising: a receiver for receiving an N-channel audio signal, N<M; parameter means for determining spatial parameters relating the N-channel audio signal to the spatial M-channel audio signal; modifying means for modifying a sweet-spot of the spatial M-channel audio signal by modifying at least one of the spatial parameters; generating means for generating the spatial M-channel audio signal by up-mixing the N-channel audio signal using the at least one modified spatial parameter.

According to another aspect of the invention, there is provided a transmission system for transmitting an audio signal, the transmission system comprising: a transmitter arranged to transmit an N-channel audio signal; and a receiver comprising: receiver for receiving the N-channel audio signal, parameter means for determining spatial parameters relating the N-channel audio signal to a spatial M-channel audio signal, N<M, modifying means for modifying a sweet-spot of the spatial M-channel audio signal by modifying at least one of the spatial parameters, generating means for generating the spatial M-channel audio signal by up-mixing the N-channel audio signal using the at least one modified spatial parameter.

According to another aspect of the invention, there is provided an audio playing device for playing a spatial M-channel audio signal, the audio playing device comprising: a receiver for receiving an N-channel audio signal, N<M; parameter means for determining spatial parameters relating the N-channel audio signal to the spatial M-channel audio signal; modifying means for modifying a sweet-spot of the spatial M-channel audio signal by modifying at least one of the spatial parameters; generating means for generating the spatial M-channel audio signal by up-mixing the N-channel audio signal using the at least one modified spatial parameter.

According to another aspect of the invention, there is provided a method of modifying a sweet-spot of a spatial M-channel audio signal, the method comprising: receiving an N-channel audio signal, N<M; determining spatial parameters relating the N-channel audio signal to the spatial M-channel audio signal; modifying the sweet-spot of the spatial M-channel audio signal by modifying at least one of the spatial parameters; generating the spatial M-channel audio signal by up-mixing the N-channel audio signal using the at least one modified spatial parameter.

According to another aspect of the invention, there is provided a method of receiving a spatial M-channel audio signal, the method comprising: receiving an N-channel audio signal, N<M; determining spatial parameters relating the N-channel audio signal to the spatial M-channel audio signal; modifying a sweet-spot of the spatial M-channel audio signal by modifying at least one of the spatial parameters; generating the spatial M-channel audio signal by up-mixing the N-channel audio signal using the at least one modified spatial parameter.

According to another aspect of the invention, there is provided a method of transmitting and receiving an audio signal, the method comprising: a transmitter transmitting an N-channel audio signal; and a receiver performing the steps of: receiving the N-channel audio signal, determining spatial parameters relating the N-channel audio signal to a spatial M-channel audio signal, N<M, modifying a sweet-spot of the spatial M-channel audio signal by modifying at least one of the spatial parameters, generating the spatial M-channel audio signal by up-mixing the N-channel audio signal using the at least one modified spatial parameter.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to an MPEG surround sound audio system. However, it will be appreciated that the invention is not limited to this application but may be applied to many other multi-channel audio systems and standards.

Figure 1:
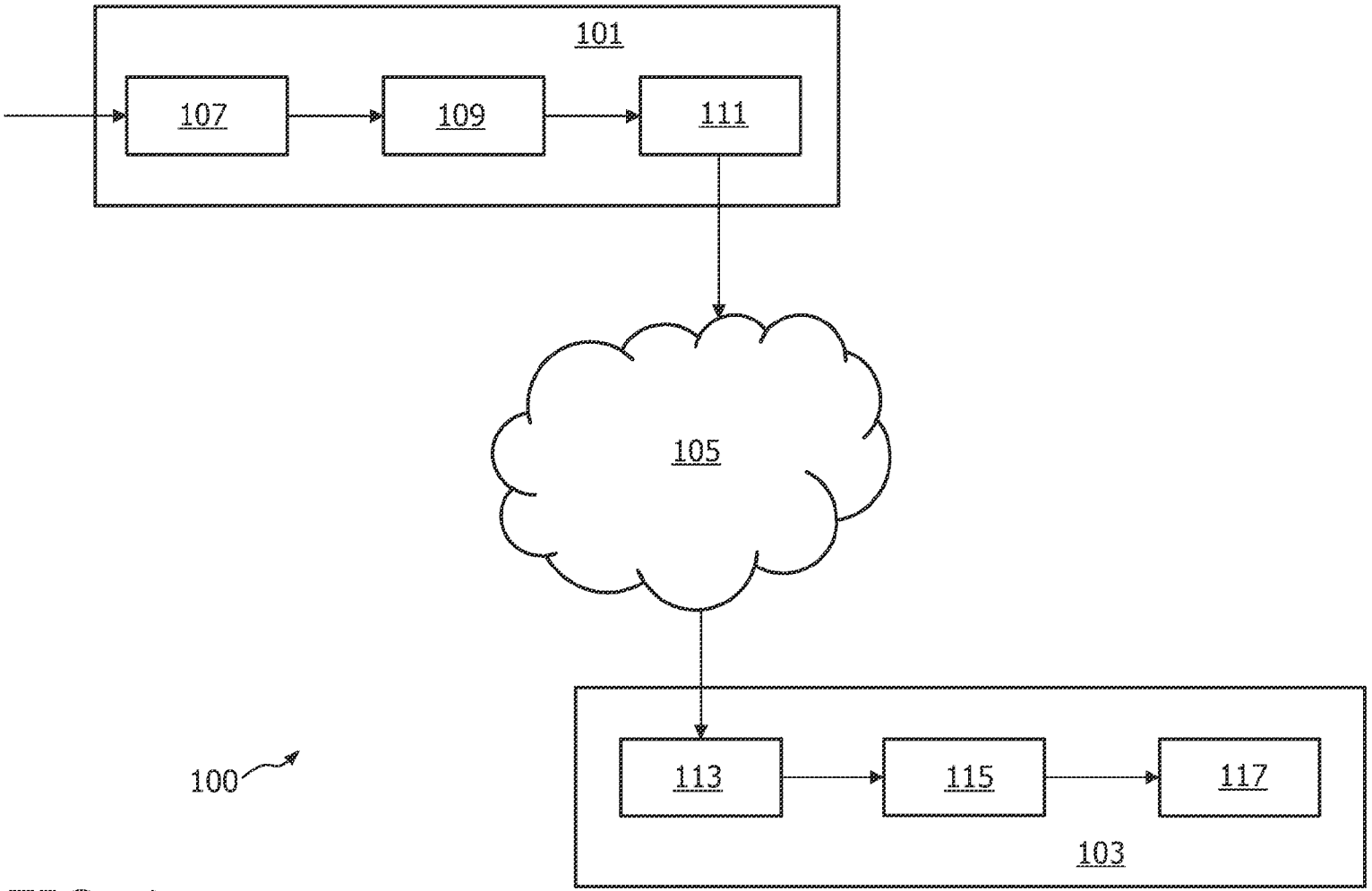
FIG. 1 is an illustration of a transmission system for communication of an audio signal in accordance with some embodiments of the invention.

FIG. 1 illustrates a transmission system 100 for communication of an audio signal in accordance with some embodiments of the invention. The transmission system 100 comprises a transmitter 101 which is coupled to a receiver 103 through a network 105 which specifically may be the Internet.

In the specific example, the transmitter 101 is a signal recording device and the receiver 103 is a signal player device but it will be appreciated that in other embodiments a transmitter and receiver may be used in other applications and for other purposes. For example, the transmitter 101 and/or the receiver 103 may be part of a transcoding functionality and may e.g. provide interfacing to other signal sources or destinations.

In the specific example where a signal recording function is supported, the transmitter 101 comprises a digitizer 107 which receives an analog multi channel signal that is converted to a digital PCM (Pulse Code Modulated) signal by sampling and analog-to-digital conversion.

The digitizer 107 is coupled to the encoder 109 of FIG. 1 which encodes the PCM signal in accordance with an encoding algorithm. In the example, the encoder 109 is an MPEG Surround encoder which encodes an M-channel signal as an N-channel signal where M>N. The MPEG Surround decoder thus generates an N-channel signal as well as spatial parametric data that allows a decoder to generate the M-channel signal. The encoder 109 may for example encode a 5.1, 6.1 or 7.1 surround sound signal as stereo signal plus spatial parametric data. The following description will focus on a scenario wherein a 5.1 stereo signal is encoded as a stereo signal plus spatial parametric data.

The encoder 109 is coupled to a network transmitter 111 which receives the encoded signal and interfaces to the Internet 105. The network transmitter may transmit the encoded signal to the receiver 103 through the Internet 105.

The receiver 103 comprises a network receiver 113 which interfaces to the Internet 105 and which is arranged to receive the encoded signal from the transmitter 101.

The network receiver 113 is coupled to a decoder 115. The decoder 115 receives the encoded signal and decodes it in accordance with a decoding algorithm. In the example, the decoder decodes the M-channel signal from the N-channel signal using the received parametric data after this has been modified in order to modify the sweet-spot of the original signal. The sweet-spot of a spatial multi-channel signal is the area/locations in which the spatial perception does not deviate significantly from the intended spatial perception, e.g. as intended by studio engineers for a standardized multi-channel speaker setup.

Specifically, in the example, the decoder 115 is an MPEG Surround decoder operating in the guided mode where the decoding is based on spatial parametric data generated by the encoder 109. However, it will be appreciated that in other embodiments, the spatial parametric data may be generated by the decoder itself and that the decoder 115 may in particular be an MPEG Surround decoder operating in the non-guided mode.

In the specific example where a signal playing function is supported, the receiver 103 further comprises a signal player 117 which receives the decoded audio signal from the decoder 115 and presents this to the user. Specifically, the signal player 117 may comprise a digital-to-analog converter, amplifiers and speakers as required for outputting the decoded audio signal.

Figure 2:
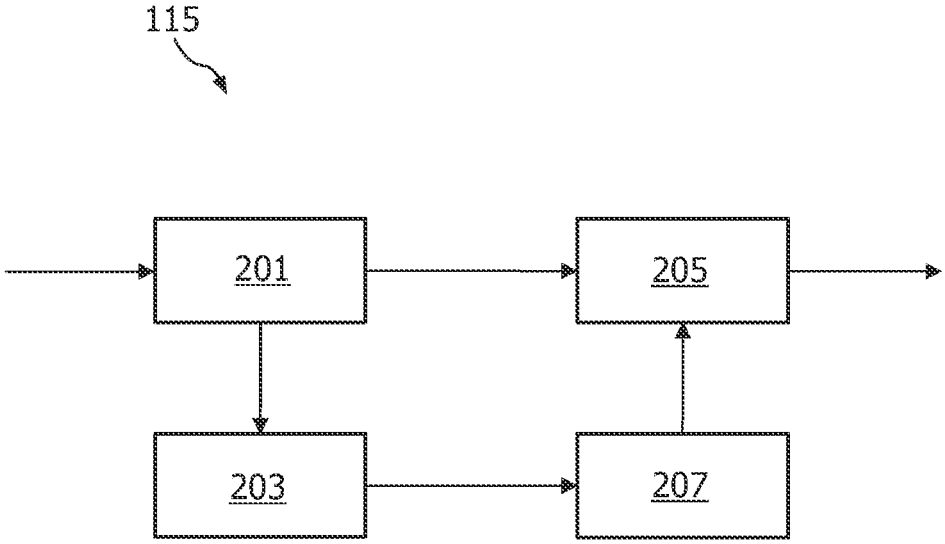
FIG. 2 is an illustration of a decoder capable of modifying a sweet-spot of a spatial M-channel audio signal in accordance with some embodiments of the invention.

FIG. 2 illustrates the decoder 115 in more detail.

The decoder 115 comprises a receiver unit 201 which receives the bitstream from the network receiver 113. The receiver comprises both the encoded stereo signal and the parametric data.

The receiver unit 201 is coupled to a parameter unit 203 which determines the spatial parameters that are to be used for generating the surround signal from the stereo signal. The spatial parameters are thus parameter data that describe a characteristic of a channel signal of the M-channel signal relative to a characteristic of a channel signal of the N-channel signal. The spatial parameters can specifically indicate how the N-channel signal should be processed to generate the M-channel signal.

In the main example, the spatial parameters are simply generated by extracting these parameters from the received bitstream, ie. the spatial parameters generated by the encoder 109 are used. However, it will be appreciated that in other embodiments, the spatial parameters may e.g. be determined by the decoder itself, e.g. by estimating these parameters from the received signal. Specifically, the decoder 115 may be an MPEG Surround decoder operating in the non-guided mode and may accordingly generate the spatial parameters from certain characteristics of the N-channel signal, such as channel intensity difference and correlation characteristics of the received stereo signal.

The receiver unit 201 is also coupled to a decoding unit 205 which decodes the stereo signal and up-mixes this to generate the 5.1 channel surround signal. The up-mixing is in the example performed in accordance with the MPEG Surround standard and is based on the determined spatial parameters. However, the spatial parameters are not used directly but rather the decoder 115 comprises a modifying unit 207, which is coupled to the parameter unit 203 and the decoding unit 205, and which changes one or more of the spatial parameters in order to modify the sweet-spot of the generated surround signal.

Thus, the decoder 115 of FIG. 2 allows a simple, efficient, high performance and low complexity manipulation of the sweet-spot of the output surround sound signal by directly modifying one or more spatial parameters used in the decoding/up-mixing process. Thus, by integrating sweet-spot manipulation and decoding/up-mixing a substantially facilitated and improved performance can be achieved.

This approach may be used to efficiently modify the shape and location of the sweet-spot. This is especially useful for domestic and automotive applications where the position of the listener differs from the original sweet-spot position. It can also be useful to create similar sound image perceptions for multiple listeners with different positions. Thus, the approach allows easy manipulation of the most desirable features for sound stage control including the following:

Front-back balance control can be applied to gradually emphasize the spatial image to the front or to the back.

Center dispersion control can be applied to create a less (or more) directional perception of the center channel.

Left-right balance control can be applied to provide a gradual shift of emphasis to the left or to the right.

Correlation or front-back dispersion control can be applied to allow control of the front-back correlation which contributes to the perceived wideness of the sound.

The approach results in very low complexity solutions for manipulating the sweet-spot and advantageously the approach can be applied in all operating modes of MPEG Surround. Furthermore, as will be described later, it is also possible to enhance the spatial image when decoding downmix signals of limited quality, such as in FM and AM radio broadcasts.

In the following, a more detailed example of the different sweet-spot manipulations will be described with reference to a 5.1 MPEG Surround system.

Figure 3:
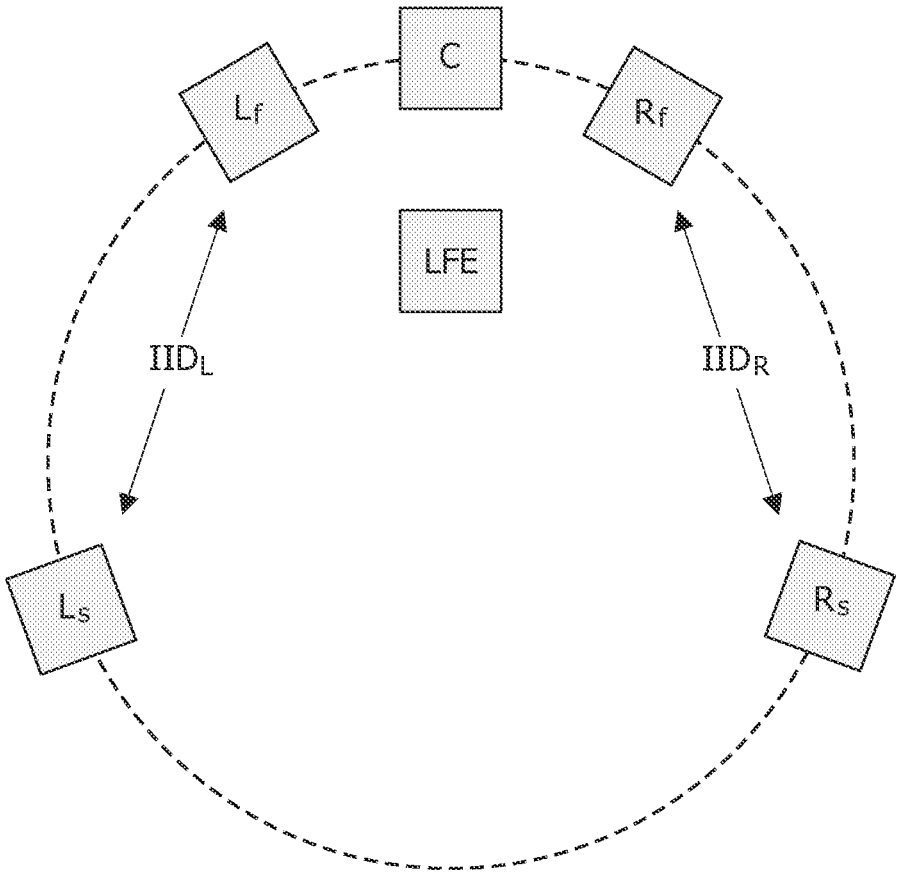
FIG. 3 is an illustration of a speaker set-up for an MPEG Surround sound system.

FIG. 3 illustrates the speaker setup on which the 6-channel output configurations of the MPEG surround algorithm are based.

Figure 4:
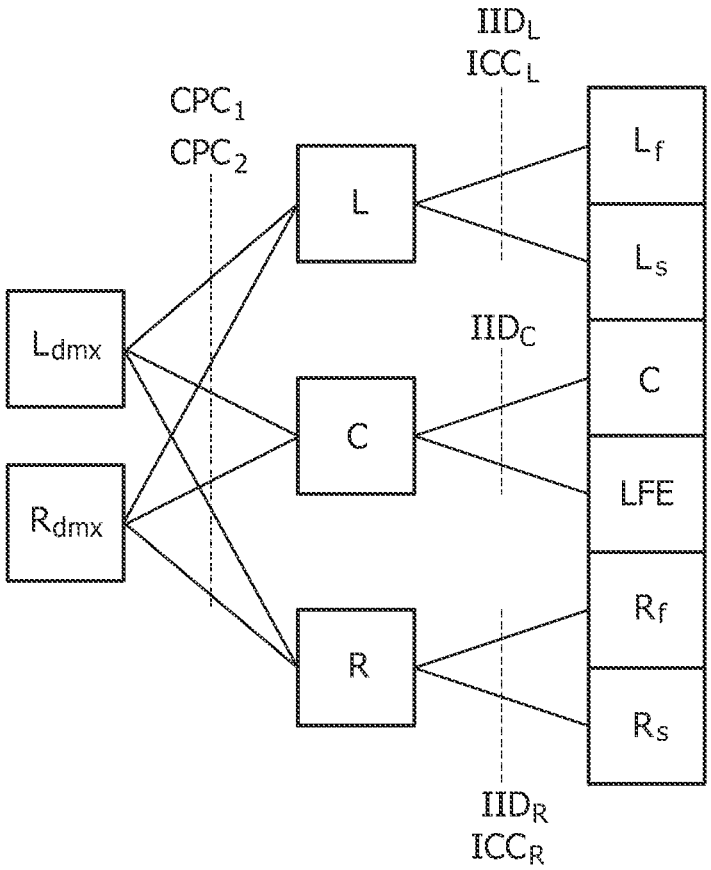
FIG. 4 is an illustration of a structure of an MPEG Surround decoder.

FIG. 4 illustrates an MPEG Surround up-mixing structure to generate the 5.1 Surround sound signal from the received stereo signal and spatial parameters. In MPEG Surround the up-mixing is performed in a cascaded process where initially two Channel Prediction Coefficients (CPCs) are used to create a left, center and right signal (L, C and R) in a first up-mixing stage using a 3×2 pre-gain matrix given by:

$$U = \begin{pmatrix} CPC_1 + 2 & CPC_2 - 1 \\ CPC_1 - 1 & CPC_2 + 2 \\ (1 - CPC_1)\sqrt{2} & (1 - CPC_2)\sqrt{2} \end{pmatrix}$$

Each of the three intermediate channels is then converted into two further channels. Specifically, the intermediate center channel is separated into the center channel and a Low Frequency Enhancement (LFE) channel using an Interchannel Intensity Difference (IID) spatial parameter. Furthermore, two IIDs and two Interchannel Correlation Coefficients (ICCs) are used to split each of the intermediate left and right signals into a front and surround channel ($L_f$, $R_f$ and. $L_s$, $R_s$) by means of a 5×5 mix matrix (where decorrelated signals are used to introduce the level of correlation indicated by the ICCs).

In some embodiments, the modifying unit 207 may modify the front-back balance by modifying a spatial parameter which indicates a relative intensity difference between at least one front channel and at least one rear channel of the spatial M-channel audio signal. Specifically, the modifying unit can modify one or more of the IID parameters.

The following describes how a simple tuning parameter can be set to gradually move the emphasis of the spatial image (sweet-spot) back and forth between the front and back. Thus, a simple tuning parameter can be used to move the location/area where the optimal surround effect is perceived to the position of the listener. This is especially useful in situations where the listener is located either to the front or the back of the center position of the loudspeakers, such as typical domestic and automotive applications.

In the embodiments of FIG. 2, the front-back balance control is achieved by modifying the IID parameters to achieve the desired effect. IID parameters are generally expressed on a logarithmic dB scale and indicate the relative energy distribution between the front and surround channel.

In the following specific example, the ICC and IID parameters will for brevity and clarity be considered to be equal for the left and right sides. This is generally the case for MPEG Surround non-guided modes. For MPEG Surround guided mode, the ICC and IID parameters are typically different for the left and right sides, and it will be appreciated that the described approach can readily be extended to such situations. Specifically, the described approach can independently be applied to both sides using the same tuning parameter, $S_{FB}$.

In the described approach, an IID parameter is used to change the front-back distribution of the signals. Specifically, increasing the IID puts more energy in the front side channels while decreasing the IID assigns more energy to the surround channels.

The IID, which is expressed in dB, can be updated by adding an offset value.

$$IID_{new}=IID_{org}+\Delta_{FB}.$$

This offset value $\Delta_{FB}$ can be determined from a simple tuning parameter $S_{FB}$ which can for example be set manually by a user or operator. For example, the playing device 103 comprising the decoder 115 can comprise an input for selecting between different sound environment emulation settings with each setting having a number of associated predetermined sweet-spot tuning parameters.

The human auditory system has a decreasing sensitivity to changes in IID for increasing reference values (positive as well as negative). For example, the following table illustrates Just Noticeable Differences (JNDs) for IID variations:

| Reference IID (dB) | JND (dB) |
|---|---|
| 0 | 0.5-1 |
| 9 | 1.2 |
| 15 | 1.5-2 |

In order to achieve a similar emphasizing effect for the entire range of IIDs, this non-linear effect can be incorporated in the IID update:

$$IID_{new}=IID_{org}+\Delta_{FB}(S_{FB},IID_{org}).$$

Since, the non-linear behavior of the auditory system is also reflected in the IID quantization vector used in MPEG Surround to map the index values to IID parameters, the IID modification can be implemented by a linear update in the index domain. Let $I_{IID,org}$ be the index corresponding to $IID_{org}$, then the IID can be updated by calculating a new IID that corresponds to the index given by:

$$I_{IID,new}=I_{IID,org}+S_{FB}.$$

Thus, a simple tuning parameter $S_{FB}$ having a linear relation to the front-back balance shift can be set to modify the front-back balance of the sweet-spot of the surround sound signal.

If it is not practical to use the IID index directly (e.g. because this is not available to the modifying unit), it is possible to switch to the index domain and back by fitting a second order polynomial to the (non-negative part of the) MPEG Surround quantization vector for IID:

$$IID=a_0 \cdot I_{IID}^2+a_1 \cdot I_{IID}+a_2,$$

where $a_0=0.1444$, $a_1=1.1056$, $a_2=0.8272$.

Thus, the IID can be mapped back to the index domain by $$I_{IID} = \frac{-a_1 + \sqrt{a_1^2 - 4a_0 \cdot (a_2 - \mathrm{abs}(IID))}}{2a_0},$$

The new index can then be determined by adding the $S_{FB}$ parameter and the IID parameter can thus be determined as:

$$IID_{new}=\mathrm{sgn}(I_{IID,new}) \cdot (a_0 \cdot (I_{IID,new})^2+a_1 \cdot \mathrm{abs}(I_{IID,new})+a_2).$$

Alternatively, interpolation based on the quantization vector can be used to determine the modified IID.

Decreasing the IID value results in a shift of energy from the front channels to the surround channels while maintaining the coherence and overall energy. However, this modification does not change the energy of the center (and LFE) channels and can therefore deform the spatial image to some extent. Increasing the IID value may similarly deform the spatial image.

In order to reduce this effect, the energy ratio between the front side channels and the center channel is preferably preserved. Mixing energy of the center channel into the side channels or vice versa could cause content (e.g. vocals) to inadvertently leak to the side channels and therefore change the spatial image. The following describes a method that substantially preserves the front side to center energy ratio and prevents center content to leak into the side channels by scaling the center channel.

In the approach, the front channels are scaled under the constraint that the energy ratio between the front side channels and the center channel is preserved:

$$\frac{E_{L_{f,new}} + E_{R_{f,new}}}{E_{C_{new}}} = \frac{E_{L_f} + E_{R_f}}{E_C}.$$

Scaling the center signal has implications for the overall energy and therefore the left and right side signals should be scaled simultaneously to compensate for the energy loss. Thus, the total energy should preferably also be conserved:

$$E_{L_{new}}+E_{R_{new}}+E_{C_{new}}=E_L+E_R+E_C,$$

where scaling is represented by:

$L_{new}=\mu\cdot L$, $R_{new}=\mu\cdot R$, $C_{new}=\lambda\cdot C$,

In the example, the left and right channels are scaled by the same factor since the spatial parameters are assumed equal for the two side signals (corresponding to an MPEG Surround non-guided mode) and thus they are both further processed by the same spatial parameters. The scaling factors μ and λ can be calculated by inserting the scaling equations into the energy conservation requirements. This yields:

$$\mu^2L^2+\mu^2R^2+\lambda^2C^2=L^2+R^2+C^2.$$

resulting in $$\lambda = \sqrt{\frac{L^2 + R^2}{C^2} \cdot (1 - \mu^2) + 1}.$$

and $$\frac{\mu^2 L^2 \cdot \frac{10^{\frac{IID_{new}}{10}}}{1 + 10^{\frac{IID_{new}}{10}}} + \mu^2 R^2 \cdot \frac{10^{\frac{IID_{new}}{10}}}{1 + 10^{\frac{IID_{new}}{10}}}}{\lambda^2 C^2} = \frac{L^2 \cdot \frac{10^{\frac{IID}{10}}}{1 + 10^{\frac{IID}{10}}} + R^2 \cdot \frac{10^{\frac{IID}{10}}}{1 + 10^{\frac{IID}{10}}}}{C^2}.$$

Rewriting yields $$\frac{\mu^2}{\lambda^2} = \frac{1 + 10^{\frac{IID_{new}}{10}}}{1 + 10^{\frac{IID}{10}}} \cdot 10^{\frac{IID - IID_{new}}{10}}.$$

and thus, $$\mu^2 = \frac{E_{ratio} + 1}{r + E_{ratio}},$$

where $$E_{ratio} = \frac{L^2 + R^2}{C^2},$$

$$r = \frac{1 + 10^{\frac{IID}{10}}}{1 + 10^{\frac{IID_{new}}{10}}} \cdot 10^{\frac{IID_{new} - IID}{10}}.$$

Thus, the expressions for μ and λ are given by $$\mu = \sqrt{\frac{E_{ratio} + 1}{r + E_{ratio}}},$$

$$\lambda = \sqrt{E_{ratio} \cdot (1 - \mu^2) + 1} = \sqrt{r} \cdot \mu.$$

The energy distribution compensation in order to maintain the overall spatial image can be performed by relatively low complexity processing. Specifically, the MPEG Surround up-mix algorithm updates the parameters at a certain update rate T. Thus, each T samples, new up-mixing matrices are calculated and these are interpolated for the samples in between. The scaling of the up-mixed signals can be integrated with the pre-gain matrix and accordingly the scaling values only have to be determined once per T samples.

With a parameter range of $$S_{FB} \in [-30, \ldots, +30],$$

the image can be shifted completely to the back (−30) and completely to the front (+30) in a perceptually meaningful sense and with an approximately linear relation between the tuning parameter value and the perceived shift in front/back balance.

Furthermore, the scaling values are determined from the value of $E_{ratio}$ which is the ratio of the energies of the intermediate signals L, R and C. For stability reasons, these energies can be smoothed (low pass-filtered). However, for MPEG Surround non-guided mode, such low-pass filtered energies of the down-mix signals $L_{dmx}$ and $R_{dmx}$ are already available as they are used to determine the IID and ICC parameters for the down-mix signal. These can be used in combination with the pre-gain matrix, which is defined as $$U = \begin{pmatrix} CPC_1 + 2 & CPC_2 - 1 \\ CPC_1 - 1 & CPC_2 + 2 \\ (1 - CPC_1)\sqrt{2} & (1 - CPC_2)\sqrt{2} \end{pmatrix}.$$

Thus, $E_{ratio}$ can be written as $$E_{ratio} = \frac{L^2 + R^2}{C^2} = \frac{1}{2} \cdot \frac{\begin{matrix}(2 \cdot CPC_1^2 + 2 \cdot CPC_1 + 5) \cdot L_{dmx}^2 + \\ (2 \cdot CPC_2^2 + 2 \cdot CPC_2 + 5) \cdot R_{dmx}^2 +\end{matrix}}{\begin{matrix}(CPC_1^2 - 2 \cdot CPC_1 + 1) \cdot L_{dmx}^2 + \\ (CPC_2^2 - 2 \cdot CPC_2 + 1) \cdot R_{dmx}^2 +\end{matrix}} \cdots \cdots \frac{(2 \cdot CPC_1 \cdot CPC_2 + CPC_1 + CPC_2 - 4) \cdot L_{dmx} \cdot R_{dmx}}{(CPC_1 \cdot CPC_2 - CPC_1 - CPC_2 + 1) \cdot L_{dmx} \cdot R_{dmx}},$$

thereby eliminating the need for any per-sample calculations for the front-back balance control.

Further complexity reduction can be obtained e.g. by using lookup tables for various equations or using low-complexity approximation functions.

In the exemplary embodiment, the decoder 115 can furthermore adjust the center dispersion thereby increasing the sweet-spot. Specifically, a center dispersion tuning parameter is used to disperse the image of the center channel to the side to obtain a less directional center. Thus, the approach allows an increase of the perceived wideness of the center by adjusting the spatial parameters and thus the spatial parameters are used to manipulate the size of the sweet-spot.

In MPEG Surround, the first up-mixing stage creates three intermediate signals L, C and R using the pre-gain matrix (ref. e.g. FIG. 4):

$$U = \begin{pmatrix} CPC_1 + 2 & CPC_2 - 1 \\ CPC_1 - 1 & CPC_2 + 2 \\ (1 - CPC_1)\sqrt{2} & (1 - CPC_2)\sqrt{2} \end{pmatrix}$$

In order to increase the center width, part of the center signal C can be mixed into the side channels L and R. Specifically, the spatial parameters $CPC_1$ and $CPC_2$ of this first up-mixing stage can be manipulated such that the center signal is mixed with the left and right signals. As can be seen from the pre-gain matrix, the CPC parameters are indicative of a relative distribution of the energy of each of the stereo signals into each of the intermediate channels. Thus, adjusting the CPC parameters allows a gradual shift of energy from (or to) the center channel to (or from) the side channels. When changing the central dispersion, the modification is typically performed symmetrically and thus the CPC values are changed identically.

As evidenced by the pre-gain matrix, if the CPC parameters are both equal to 1, the lower row contains only zeroes and therefore no center signal is generated. Also, for this setting, the gain factors (matrix coefficients) for the left and right signals are increased and thus the entire center signal is fully dispersed into the left and right channels. Conversely, when decreasing the CPCs the center energy increases while the left and right signals' energy reduces.

Thus, center dispersion can be increased by increasing the CPC parameter values toward 1. In this way, the center signal is (partly) mixed into the side channels resulting in a wider spatial image for the center channel signal.

Specifically, new CPC values can be determined from a tuning parameter $S_{CD}$ according to $$CPC_{x,new} = \begin{cases} 1 - (1 - S_{CD}) \cdot (1 - CPC_x), & \text{for } S_{CD} \geq 0, \\ (1 + S_{CD}) \cdot (1 + CPC_x) - 1, & \text{for } S_{CD} < 0, \end{cases}$$

For negative values of $S_{CD}$, the CPC values are moved towards −1 thereby narrowing the perceptual width of the surround signal. The range of the tuning parameter $S_{CD}$ can preferably be set to [−1,1].

In the exemplary embodiment, the decoder 115 can furthermore shift the spatial sound image to the left or to the right thereby allowing the sweet-spot to be moved accordingly. This may be particularly useful when a listener is positioned to the left or right of the original sweet-spot.

The left-right distribution of the signal energy is obtained in the first up-mixing step where the signals L, C and R are generated using the prediction parameters $CPC_1$ and $CPC_2$. The balance control uses these prediction parameters to achieve a low complexity manipulation of the sweet-spot location.

Specifically, since the $CPC_1$ parameter controls the contribution of the left down-mix channel and the $CPC_2$ parameter controls the contribution of the right down-mix channel, the balance can be shifted to the left or right by reducing the parameters relative to each other. Thus, decreasing $CPC_1$ shifts the balance to the right, while decreasing $CPC_2$ shifts it to the left.

Specifically, the adjustment of the CPC parameters for balance control can be performed in a similar way to that used for center width reduction by the center dispersion control parameter. The parameters are either shifted towards a CPC value of −1, or are left unmodified depending on the sign of a balance control tuning parameter $S_{LR}$:

$$CPC_{1,new} = \begin{cases} CPC_1 & \text{for } S_{LR} < 0, \\ (1 - S_{LR}) \cdot (1 + CPC_1) - 1 & \text{for } S_{LR} \geq 0, \end{cases}$$

$$CPC_{2,new} = \begin{cases} (1 + S_{LR}) \cdot (1 + CPC_2) - 1 & \text{for } S_{LR} < 0, \\ CPC2 & \text{for } S_{LR} \geq 0. \end{cases}$$

A parameter range of $$S_{LR} \epsilon [-1, \ldots, +1],$$

provides a reasonable amount of balance control without negatively affecting the perceptual effects associated with the center energy.

Evaluating the pre-gain matrix illustrates that it is not possible to create an absolute balance scale without increasing the center signal's energy by simply modifying the CPC parameters. However, a reduced balance control is generally sufficient as most typical sweet-spot locations only deviate relatively little from the central listening position.

In the exemplary embodiment, the decoder 115 can furthermore modify a front to back dispersion thereby allowing control of the perceived wideness of the sound and thus increasing the sweet-spot.

Specifically, the ICC parameters used in the second stage of the up-mixing to generate the front and surround channels of the left and right side is modified to increase or decrease the correlation thereby affecting the front/back dispersion.

Specifically, the adjustment of the ICC parameter is similar to the adjustments of the CPC parameters for controlling the center dispersion except that the adjusted ICC parameter is limited to the range from 0 to 1. Thus, using the front back dispersion tuning parameter $S_{CR}$ the new correlation parameters may be determined as:

$$ICC_{new} = \begin{cases} (1 + S_{CR}) \cdot ICC & \text{for } S_{CR} < 0, \\ 1 - (1 - S_{CR}) \cdot (1 - ICC) & \text{for } S_{CR} \geq 0. \end{cases}$$

where $S_{CR} \in [-1, \ldots, +1]$.

The following table provides an overview of the specific spatial parameters that are modified to achieve different sweet-spot manipulations:

| Tuning parameter | Affected spatial parameters | Tuning parameter | Parameter range |
|---|---|---|---|
| Front/Back dispersion | ICC | $S_{CR}$ | [−1, . . . , +1] |
| Center dispersion | $CPC_1$ and $CPC_2$ | $S_{CD}$ | [−1, . . . , +1] |
| Left-right balance control | $CPC_1$ or $CPC_2$ | $S_{LR}$ | [−1, . . . , +1] |
| Front-back balance control | IID (+L + C + R) | $S_{FB}$ | [−30, . . . , +30] |

In the specific embodiment, all of the tuning parameters are used simultaneously. However, the order in which the modifications are applied may affect the achieved quality.

Specifically, center dispersion and left-right balance control affect each other since they use the same spatial parameters. Balance control maintains some energy in the center channel while the center dispersion adjustment mixes (part of) the center energy to both left and right. Hence, a lot of energy ends up in the side channel that should be attenuated by balance control when center dispersion is performed after balance control. Therefore, center dispersion adjustments can be performed first, allowing balance control to operate properly.

Front-back balance control uses the CPC parameters in the calculation of the scaling factors. Typically, the actual parameters that will be used in the up-mixing process should be used in the calculation. Hence, calculations for the front-back balance control can be performed after the calculations for center dispersion and the left-right balance control.

Calculations for the front/back dispersion adjustment are not affected by any of the other presented tuning parameters. Neither does the correlation adjustment affect the other tuning parameters. Therefore the modification of this parameter can be arbitrarily ordered within the other calculations.

It will be appreciated that the described principles can be applied in both MPEG Surround decoders operating in guided mode and in non-guided mode. When operating in non-guided mode, the spatial parameters are determined by the decoder itself based on characteristics of the received stereo signal whereas in guided mode the spatial parameters are generated and received from the encoder.

A specific example in which the described approach may provide an improved listening experience in connection with non-guided mode operation is where a stereo signal (e.g. a conventional stereo signal) is received which does not have very distinct left and right channels. In order to optimize surround experience for this type of signals a specific listening setting or mode can be provided by the algorithm.

Conventionally, poor reception of a radio station can result in two kinds of effects for the two-channel output of the receiver (a combination of both is also common):

Noisy sound.

No stereo sound reproduction or switching between stereo and mono.

Experiments have shown that a stereo signal with static noise does not significantly affect the spatial image. The noise ends up in all outputs as it also does for a stereo output.

However, more dynamic noise affects the spatial characteristics of the receiver output more clearly. Mostly this kind of noise results in fast switching between stereo and mono reproduction in a radio receiver. With a standard MPEG Surround non-guided algorithm such a signal results in spatial instability where the complete sound collapses into the center speaker when the input switches to mono.

This is also a disadvantage for mono-based FM stations and all AM stations, since a mono signal ($L_{dmx}$=$R_{dmx}$) has no inter-channel intensity difference and full correlation and therefore the spatial parameters will be constant. The resulting values for the CPC parameters put the bulk of the signal energy in the center channel and a poor surround sound experience is provided.

Moreover, due to the way FM stereo signals are transmitted (mono (sum) signal and differential signal) the spatial properties of the down-mix can be reduced as the differential signal is the first to deteriorate for poor reception. Consequently, the spatial reconstruction by the MPEG Surround non-guided algorithm is much more prone to be oriented to the center than regular stereo signals.

Thus, the main disadvantage of having radio signals as a source to non-guided MPEG Surround systems is the high probability that the spatial characteristics which steer the algorithm can be lost causing the signal to be concentrated in the front center speaker.

However, the described decoder provides a low complexity sweet-spot manipulation which can improve the provided surround sound experience. Specifically, a low complexity solution achieving a satisfying spatial image for mono signals can use the center dispersion tuning parameter. Setting this parameter to e.g. 0.5, causes part of the energy that would be put in the center signal to be dispersed to the side signals L and R. For mono signals the IID of 0 dB causes an even distribution between front and rear speakers.

As a result, even for a mono input, the algorithm can effectively distribute the signal over all output channels. For stereo signals the widening creates an enhanced spatial image.

Figure 5:
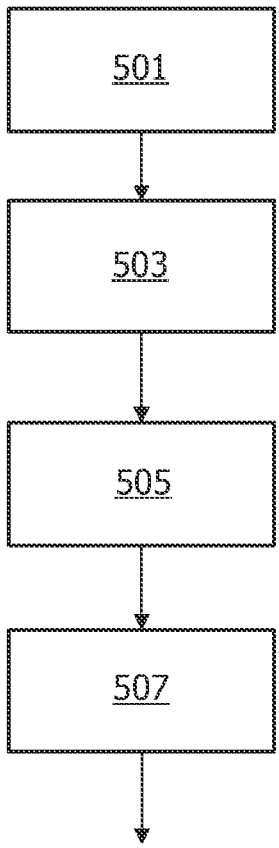
FIG. 5 is an illustration of a method of modifying a sweet-spot of a spatial M-channel audio signal in accordance with some embodiments of the invention.

FIG. 5 illustrates a method of modifying a sweet-spot of a spatial M-channel audio signal. The method initiates in step 501 wherein an N-channel audio signal is received with N<M.

Step 501 is followed by step 503 wherein spatial parameters relating the N-channel audio signal to the spatial M-channel audio signal are determined.

Step 503 is followed by step 505 wherein the sweet-spot of the spatial M-channel audio signal is modified by modifying at least one of the spatial parameters.

Step 505 is followed by step 507 wherein the spatial M-channel audio signal is generated by up-mixing the N-channel audio signal using the at least one modified spatial parameter.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An apparatus for modifying a sweet-spot of a spatial M-channel audio signal, M indicating a first number of channels, the apparatus comprising:

a receiver for receiving an N-channel audio signal, N indicating a second number of channels, the second number being less than the first number;

parameter means for determining a plurality of spatial parameters relating characteristics of the N-channel audio signal to characteristics of the spatial M-channel audio signal;

modifying means for modifying at least one of a front to back balance, a left to right balance, and a front to back dispersion, of a sweet-spot of the spatial M-channel audio signal by modifying at least one of the plurality of spatial parameters; and generating means for generating the spatial M-channel audio signal by up-mixing the N-channel audio signal using the at least one modified spatial parameter.

2. The apparatus of claim 1, wherein a first of the plurality of spatial parameters is indicative of an intensity difference between at least one front channel and at least one rear channel of the spatial M-channel audio signal and modifies the front to back balance of the sweet-spot.

3. The apparatus of claim 2, wherein the first spatial parameter is an interchannel intensity difference between at least one front channel and at least one rear channel.

4. The apparatus of claim 3, wherein the interchannel intensity difference has a quantization index.

5. The apparatus of claim 2, wherein the first spatial parameter is modified to scale at least one front channel to reduce a front side channel to center channel energy ratio variation for the spatial M-channel audio signal.

6. The apparatus of claim 1, wherein a second of the plurality of spatial parameters is indicative of a relative distribution of a signal of at least one channel of the N-channel audio signal between a center channel and at least one side channel and modifies a center dispersion of the sweet-spot.

7. The apparatus of claim 6, wherein the second spatial parameter is a channel prediction coefficient.

8. The apparatus of claim 1, wherein a third of the plurality of spatial parameters is indicative of a relative distribution of a signal of at least one channel of the N-channel audio signal between at least one right side channel and at least one left side channel and modifies the left to right balance of the sweet-spot.

9. The apparatus of claim 8, wherein the third spatial parameter is a channel prediction coefficient.

10. The apparatus of claim 1, wherein a fourth of the plurality of spatial parameters is indicative of a relative correlation between at least one front channel and at least one rear channel of the spatial M-channel audio signal and modifies the front to back dispersion of the sweet-spot.

11. The apparatus of claim 10, wherein the fourth spatial parameter is an interchannel correlation coefficient between the at least one front channel and the at least one rear channel.

12. The apparatus of claim 1, wherein the N-channel audio signal corresponds to a down-mix of the spatial M-channel audio signal and includes encoder spatial parameters relating the down-mixed N-channel audio signal to the spatial M-channel audio signal, and the plurality of spatial parameters are determined from the encoder spatial parameters.

13. The apparatus of claim 1, wherein the plurality of spatial parameters are determined from characteristics of signals of the channels of the N-channel audio signal.

14. The apparatus of claim 1, wherein the N-channel audio signal is an MPEG surround signal.

15. A player for receiving a spatial M-channel audio signal, M indicating a first number of channels, the player comprising:

a receiver for receiving an N-channel audio signal, N indicating a second number of channels, the second number being less than the first number;

parameter means for determining a plurality of spatial parameters relating the N-channel audio signal to the spatial M-channel audio signal;

modifying means for modifying at least one of a front to back balance, a left to right balance, and a front to back dispersion, of a sweet-spot of the spatial M-channel audio signal by modifying at least one of the plurality of spatial parameters; and generating means for generating the spatial M-channel audio signal by up-mixing the N-channel audio signal using the at least one modified spatial parameter.

16. A transmission system for transmitting an audio signal, the transmission system comprising:

a transmitter configured to transmit an N-channel audio signal N indicating a second number of channels; and a player comprising:

a receiver for receiving the N-channel audio signal, parameter means for determining spatial parameters relating the N-channel audio signal to a spatial M-channel audio signal, M indicating a first number of channels, the first number being greater than the second number, modifying means for modifying at least one of a front to back balance, a left to right balance, and a front to back dispersion, of a sweet-spot of the spatial M-channel audio signal by modifying at least one of the plurality of spatial parameters, and generating means for generating the spatial M-channel audio signal by up-mixing the N-channel audio signal using the at least one modified spatial parameter.

17. An audio playing device for playing a spatial M-channel audio signal, M indicating a first number of channels, the audio playing device comprising:

a receiver for receiving an N-channel audio signal, N indicating a second number of channels, the second number being less than the first number;

parameter means for determining a plurality of spatial parameters relating the N-channel audio signal to the spatial M-channel audio signal;

modifying means for modifying at least one of a front to back balance, a left to right balance, and a front to back dispersion, of a sweet-spot of the spatial M-channel audio signal by modifying at least one of the plurality of spatial parameters; and generating means for generating the spatial M-channel audio signal by up-mixing the N-channel audio signal using the at least one modified spatial parameter.

18. A method of modifying a sweet-spot of a spatial M-channel audio signal, M indicating a first number of channels, the method comprising acts of:

receiving an N-channel audio signal, N indicating a second number of channels, the second number being less than the first number;

determining a plurality of spatial parameters relating the N-channel audio signal to the spatial M-channel audio signal;

modifying at least one of a front to back balance, a left to right balance, and a front to back dispersion, of a sweet-spot of the spatial M-channel audio signal by modifying at least one of the plurality of spatial parameters; and generating the spatial M-channel audio signal by up-mixing the N-channel audio signal using the at least one modified spatial parameter.

19. A method of receiving a spatial M-channel audio signal, M indicating a first number of channels, the method comprising acts of:

receiving an N-channel audio signal, N indicating a second number of channels, the second number being less than the first number;

determining a plurality of spatial parameters relating the N-channel audio signal to the spatial M-channel audio signal;

modifying at least one of a front to back balance, a left to right balance, and a front to back dispersion, of a sweet-spot of the spatial M-channel audio signal by modifying at least one of the a plurality of spatial parameters; and generating the spatial M-channel audio signal by up-mixing the N-channel audio signal using the at least one modified spatial parameter.

20. A method of transmitting and receiving an audio signal, the method comprising acts of:

a transmitter transmitting an N-channel audio signal; and a player performing the steps of:

receiving the N-channel audio signal, determining a plurality of spatial parameters relating the N-channel audio signal to a spatial M-channel audio signal, N indicating a second number of channels, modifying at least one of a front to back balance, a left to right balance, and a front to back dispersion, of a sweet-spot of the spatial M-channel audio signal by modifying at least one of the plurality of spatial parameters, and generating a spatial M-channel audio signal by up-mixing the N-channel audio signal using the at least one modified spatial parameter, M indicating a first number of channels, the first number being greater than the second number.

21. A non-transitory computer readable media comprising a computer program, which when executed by a processor performs a method comprising acts of:

receiving an N-channel audio signal, N indicating a second number of channels;

determining a plurality of spatial parameters relating the N-channel audio signal to a spatial M-channel audio signal, M indicating a first number of channels, the first number being greater than the second number;

modifying at least one of a front to back balance, a left to right balance, and a front to back dispersion, of a sweet-spot of the spatial M-channel audio signal by modifying at least one of the plurality of spatial parameters; and generating the spatial M-channel audio signal by up-mixing the N-channel audio signal using the at least one modified spatial parameter.

22. An apparatus for modifying a sweet-spot of a spatial M-channel audio signal, M indicating a first number of channels, the apparatus comprising:

an input configured to receive an N-channel audio signal, N indicating a second number of channels, the second number being less than the first number;

a parameter unit communicating with the input and configured to determine a plurality of spatial parameters relating the N-channel audio signal to the spatial M-channel audio signal;

a modifying unit communicating with the parameter unit and configured to modify at least one of a front to back balance, a left to right balance, and a front to back dispersion, of a sweet-spot of the spatial M-channel audio signal by modifying at least one of the plurality of spatial parameters; and a generating unit communicating with the receiver and the parameter unit and the modifying unit and configured to generate the spatial M-channel audio signal by up-mixing the N-channel audio signal depending on one or more of the plurality of spatial parameters and on the at least one modified spatial parameter.

23. A player for receiving a spatial M-channel audio signal, M indicating a first number of channels, the player comprising:

a receiving unit configured to receive an N-channel audio signal, N indicating a second number of channels, the second number being less than the first number;

a parameter unit communicating with the receiver and configured to determine a plurality of spatial parameters relating the N-channel audio signal to the spatial M-channel audio signal;

a modifying unit communicating with the parameter unit and configured to modify at least one of a front to back balance, a left to right balance, and a front to back dispersion, of a sweet-spot of the spatial M-channel audio signal by modifying at least one of the plurality of spatial parameters; and a generating unit communicating with the receiver and the parameter unit and the modifying unit and configured to generate the spatial M-channel audio signal by up-mixing the N-channel audio signal depending on one or more of the plurality of spatial parameters and on the at least one modified spatial parameter.

24. A transmission system for transmitting an audio signal, the transmission system comprising:

a transmitter configured to transmit an N-channel audio signal, N indicating a second number of channels; and a player comprising:

a receiver unit configured to receive the N-channel audio signal, a parameter unit communicating with the receiver and configured to determine a plurality of spatial parameters relating the N-channel audio signal to a spatial M-channel audio signal, a modifying unit communicating with the parameter unit and configured to modify at least one of a front to back balance, a left to right balance, and a front to back dispersion, of a sweet-spot of the spatial M-channel audio signal by modifying at least one of the plurality of spatial parameters, M indicating a first number of channels, the first number being greater than the second number, and a generating unit communicating with the receiver and the parameter unit and the modifying unit and configured to generate the spatial M-channel audio signal by up-mixing the N-channel audio signal depending on one or more of the plurality of spatial parameters and on the at least one modified spatial parameter.

25. An audio playing device for playing a spatial M-channel audio signal, M indicating a first number of channels, the audio playing device comprising:

a receiver configured to receive an N-channel audio signal, N indicating a second number of channels, the second number being less than the first number;

a parameter unit communicating with the receiver and configured to determine a plurality of spatial parameters relating characteristics of the N-channel audio signal to the characteristics of spatial M-channel audio signal;

a modifying unit communicating with the parameter unit and configured to modify at least one of a front to back balance, a left to right balance, and a front to back dispersion, of a sweet-spot of the spatial M-channel audio signal by modifying at least one of the spatial parameters;

a generating unit communicating with the receiver and the parameter unit and the modifying unit and configured to generate the spatial M-channel audio signal by up-mixing the N-channel audio signal depending on one or more of the plurality of spatial parameters and on the at least one modified spatial parameter;

a decoder configured to convert the spatial M-channel audio signal into an decoded sound signal; and a signal player configured to convert the decoded sound signal into sound.

26. The apparatus of claim 25 wherein a second of the plurality of spatial parameters is indicative of a relative distribution of a signal of at least one channel of the N-channel audio signal between a center channel and at least one side channel and modifies a center dispersion of the sweet-spot.

27. The apparatus of claim 25 wherein a third of the plurality of spatial parameters is indicative of a relative distribution of a signal of at least one channel of the N-channel audio signal between at least one right side channel and at least one left side channel and modifies a left to right balance of the sweet-spot.

28. The apparatus of claim 25 wherein a first of the plurality of spatial parameters is indicative of a relative correlation between at least one front channel and at least one rear channel of the spatial M-channel audio signal and modifies a front to back balance of the sweet-spot.

* * * * *